US012320624B1

(12) United States Patent
Laxton et al.

(10) Patent No.: US 12,320,624 B1
(45) Date of Patent: Jun. 3, 2025

(54) SACRIFICIAL DEVICE FOR SUB-CALIBER MUNITION

(71) Applicants: Eric J. Laxton, Spotsylvania, VA (US); Noel J. Colon-Diaz, Fredericksburg, VA (US)

(72) Inventors: Eric J. Laxton, Spotsylvania, VA (US); Noel J. Colon-Diaz, Fredericksburg, VA (US)

(73) Assignee: United States of America, as represented by the Secretary of the Navy, Arlington, VA (US)

( * ) Notice: Subject to any disclaimer, the term of this patent is extended or adjusted under 35 U.S.C. 154(b) by 0 days.

(21) Appl. No.: 18/656,665

(22) Filed: May 7, 2024

(51) Int. Cl.
*F42B 14/06* (2006.01)
*F42B 10/06* (2006.01)
*F42B 10/44* (2006.01)

(52) U.S. Cl.
CPC ..... *F42B 14/06* (2013.01); *F42B 10/06* (2013.01); *F42B 14/064* (2013.01); *F42B 10/44* (2013.01)

(58) Field of Classification Search
CPC ..... F42B 10/02; F42B 10/06; F42B 10/44; F42B 14/00; F42B 14/06; F42B 14/061; F42B 14/062; F42B 14/067; F42B 14/068
USPC ..... 102/520, 521, 522, 523; 244/3.3
See application file for complete search history.

(56) References Cited

U.S. PATENT DOCUMENTS 2,984,181 A * 5/1961 Baldwin, Jr. ..... F42B 10/06 102/385
5,158,509 A * 10/1992 Ebaugh ..... F42B 10/06 264/273
9,759,535 B2 * 9/2017 Citro ..... F42B 10/14
11,639,844 B2 * 5/2023 Pavier ..... F42B 12/04 102/521

* cited by examiner

*Primary Examiner* — James S Bergin
(74) *Attorney, Agent, or Firm* — Gerhard W. Thielman

(57) ABSTRACT

A device is provided for inhibiting pitch and yaw within a barrel bore of a gun-launched projectile having a nose and a boattail. The device includes an endcap, a cruciform and a plug. The endcap attaches to the boattail. The endcap includes a center cavity. The cruciform includes a central ring that engages around the endcap. The cruciform further includes a plurality of radial spokes. Each spoke extends from the ring and ends in a flange that engages the bore. The plug inserts into the ring and the cavity. After the projectile launches from the bore, the plug sheers away from the endcap, thereby causing the cruciform to separate from the endcap. Preferably, the endcap, cruciform and plug are composed of aluminum alloy.

7 Claims, 7 Drawing Sheets

400

SACRIFICIAL DEVICE FOR SUB-CALIBER MUNITION

STATEMENT OF GOVERNMENT INTEREST

The invention described was made in the performance of official duties by one or more employees of the Department of the Navy, and thus, the invention herein may be manufactured, used or licensed by or for the Government of the United States of America for governmental purposes without the payment of any royalties thereon or therefor.

BACKGROUND

The invention relates generally to projectile stabilizers inside a gun barrel, in particular for sub-caliber munitions.

Most gun launched munition projectiles interface to the gun mount, particularly the gun barrel chamber. This is accomplished through two broad categories: fixed for small arms and separated for artillery. Larger caliber munitions typically use a separated design in which the projectile and propellant charge system often interface with the gun mount as separate components. Despite this, in some large caliber systems these separated components may interface together during gun mount handling and ramming operations. Such cases can be referred to as semi-fixed ammunition.

Conventionally, projectile auxiliary features, such as obturators and rotating bands are integrated into the munition to seal the projectile reliably into the chamber of the gun barrel. This concurrently enables these components to seal high pressure gases during the interior ballistic cycle.

SUMMARY

Conventional stabilizers for gun-launched projectiles yield disadvantages addressed by various exemplary embodiments of the present invention. In particular, various exemplary embodiments provide a device for inhibiting pitch and yaw within a barrel bore of a gun-launched projectile having a nose and a boattail. The device includes an endcap, a cruciform and a plug. The endcap attaches to the boattail and includes a center cavity.

The cruciform includes a central ring that engages around the endcap. The cruciform further includes a plurality of radial spokes. Each spoke extends from the ring and ends in a flange that engages the bore. The plug inserts into the ring and the cavity. After the projectile launches from the bore, the plug sheers away from the endcap, thereby causing the cruciform to separate from the endcap. Preferably, the endcap, cruciform and plug are composed of aluminum alloy.

BRIEF DESCRIPTION OF THE DRAWINGS

These and various other features and aspects of various exemplary embodiments will be readily understood with reference to the following detailed description taken in conjunction with the accompanying drawings, in which like or similar numbers are used throughout, and in which.

DETAILED DESCRIPTION

In the following detailed description of exemplary embodiments of the invention, reference is made to the accompanying drawings that form a part hereof, and in which is shown by way of illustration specific exemplary embodiments in which the invention may be practiced. These embodiments are described in sufficient detail to enable those skilled in the art to practice the invention. Other embodiments may be utilized, and logical, mechanical, and other changes may be made without departing from the spirit or scope of the present invention. The following detailed description is, therefore, not to be taken in a limiting sense, and the scope of the present invention is defined only by the appended claims.

The disclosure generally employs quantity units with the following abbreviations: length in meters (m) and inches ("), mass in grams (g) or pounds-mass ($lb_m$), time in seconds(s), angles in degrees (°), and force in newtons (N) or pounds-force ($lb_f$). Supplemental measures can be derived from these, such as density in grams-per-cubic-centimeters ($g/cm^3$), moment of inertia in gram-square-centimeters ($kg\text{-}m^2$) and the like.

Figure 1:
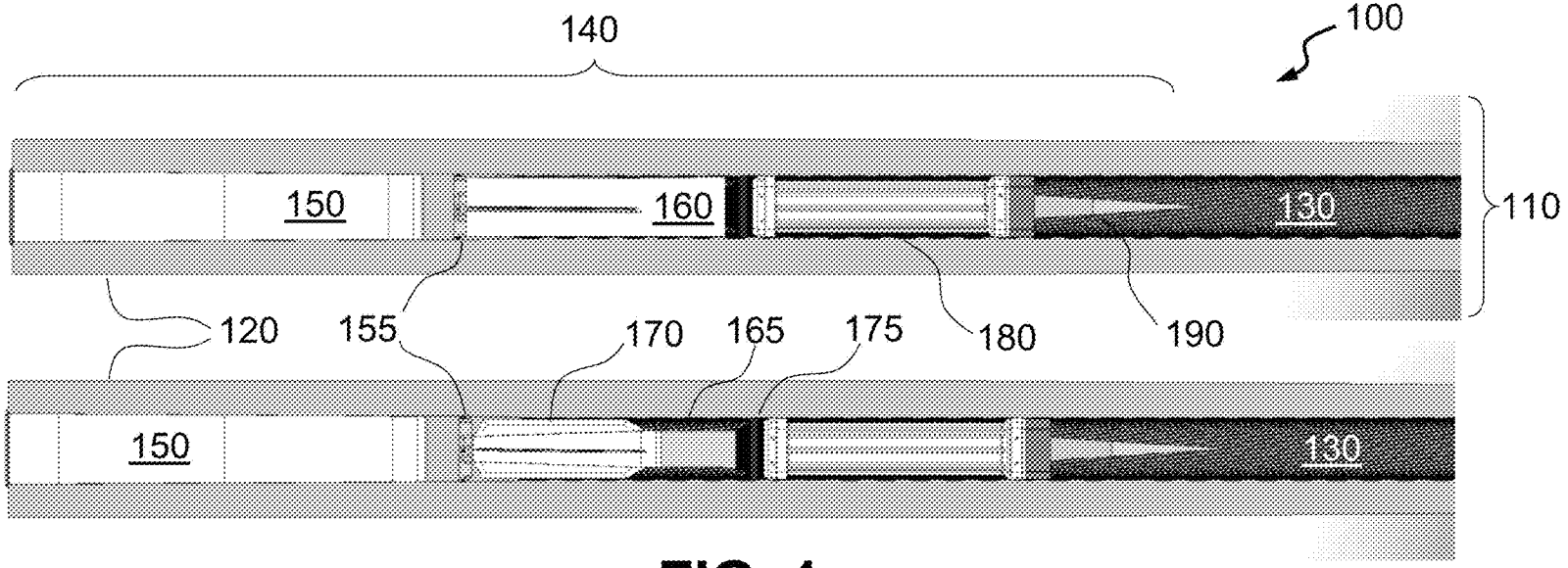
FIG. 1 is an elevation cross-section view of a gun barrel with a projectile, including propellant and payload portions.

FIG. 1 shows an elevation cross-section view 100 of a gun system 110. A barrel 120 with a circular bore 130 includes a munition 140 therein. The munition 140 includes a main propellant charge 150, a sacrificial ramming insert 155 and a supplemental propellant charge 160 that surrounds an internal fore cylinder 165 and an aft boattail 170. An obturator 175 is disposed between the fore cylinder 165 and an advanced projectile payload 180 with a conical nose cone 190 that connects to the fore cylinder 165.

Figure 2:
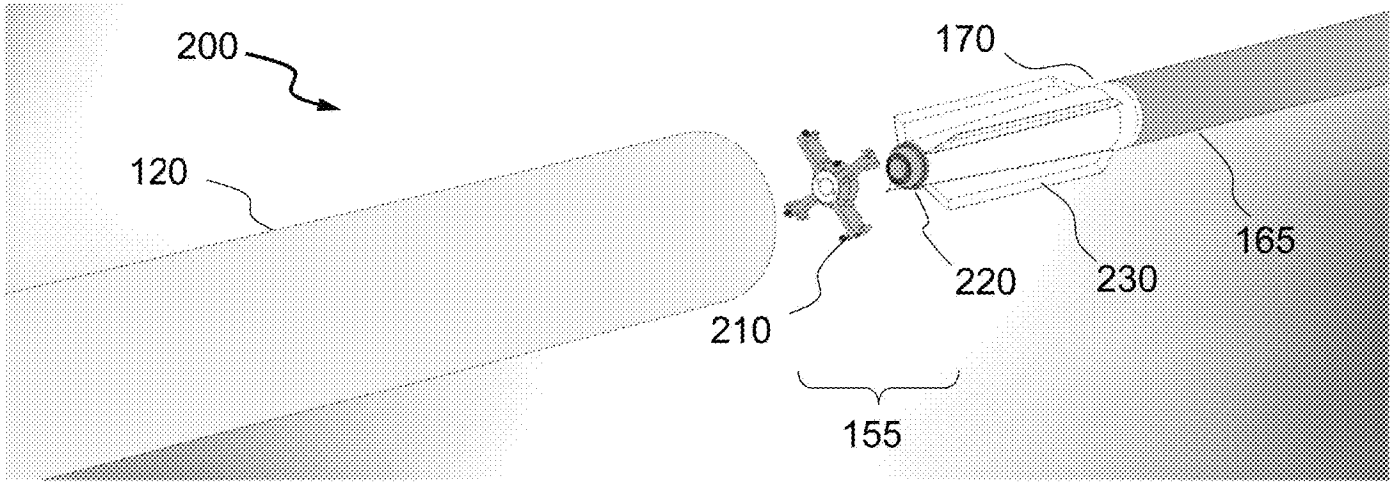
FIG. 2 is an isometric view of the gun barrel with the projectile.

FIG. 2 shows a perspective view 200 of the barrel 120 and the boattail 170 and cylinder 165 after ejection from the bore 130. The insert 155 includes a radial spacer 210 and a boattail attachment 220 to the boattail 170 showing its fins 230. The spacer 210 separates from the attachment 220 after launching the projectile 140 and is sacrificed. The spacer 210 inhibits pitch and yaw of the payload 180 within the bore 130. The bore 130 has a 5" diameter, and the spacer 210 has a corresponding span of 4.985". This configuration is merely exemplary and not limiting, being applicable to other size gun systems.

Figure 3A:
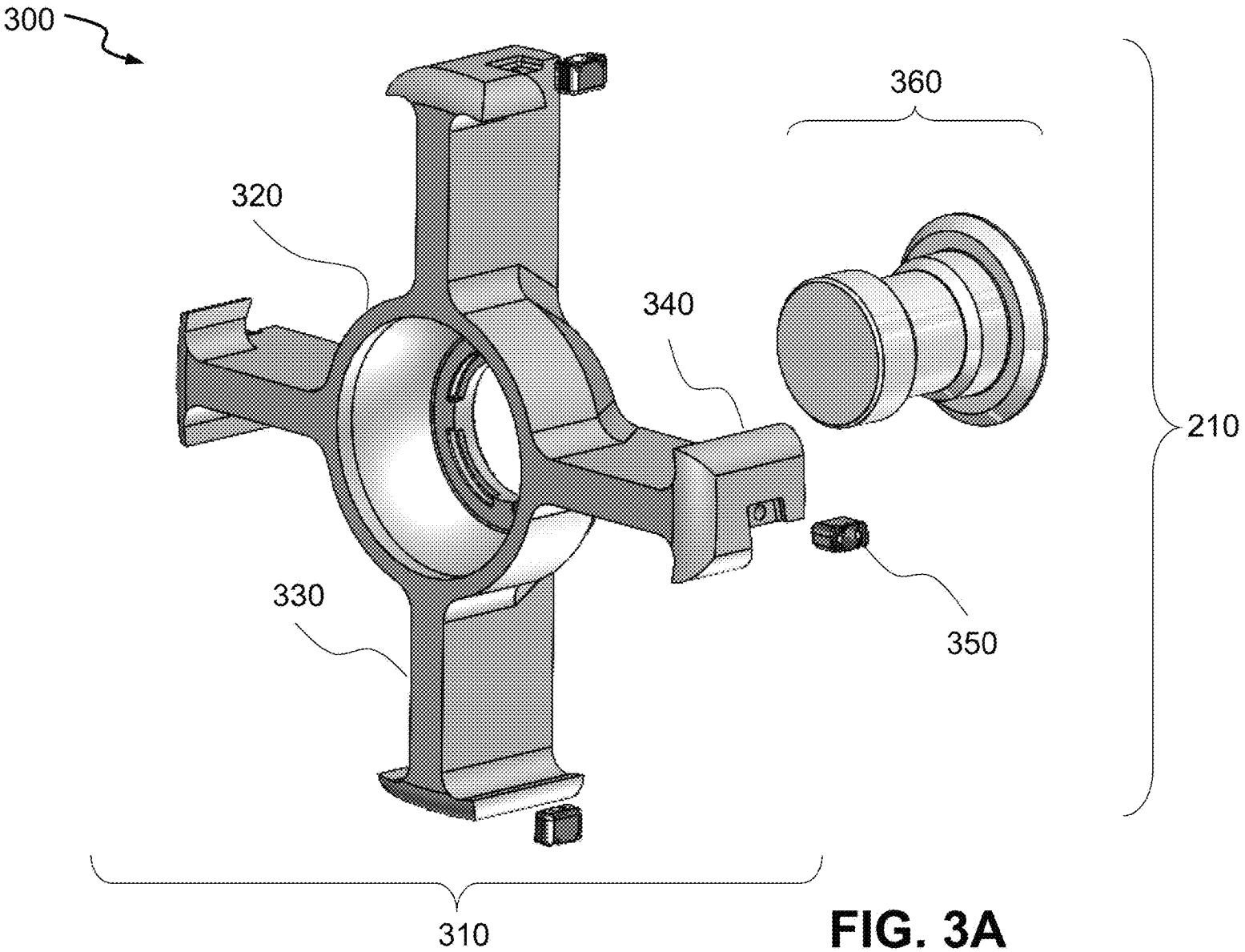
FIGS. 3A, 3B and 3C are perspective explosive views respectively of a spacer, a boattail aft section and a cruciform insert.
Figure 3B:
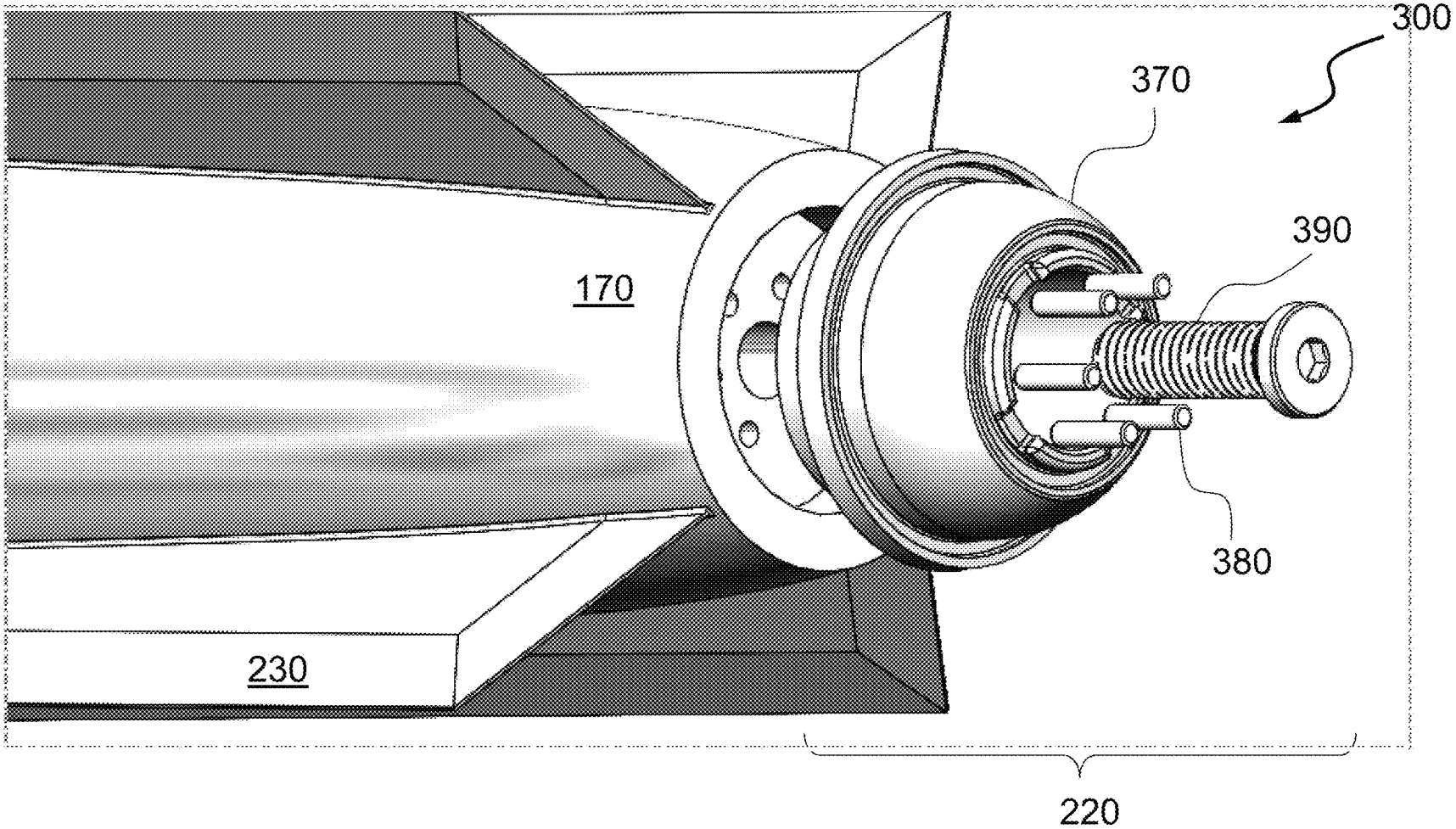
Figure 3C:
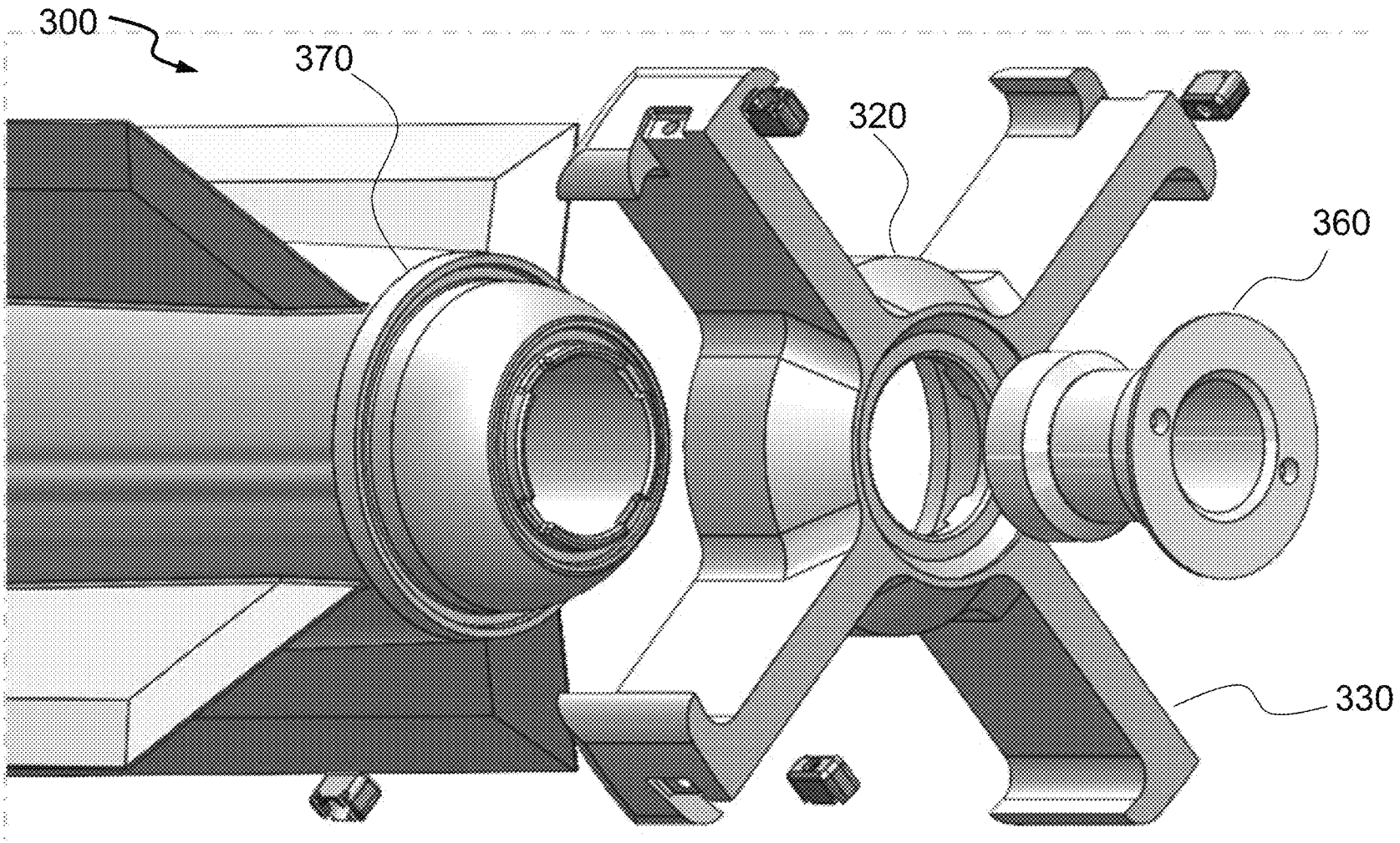

FIGS. 3A, 3B and 3C show perspective exploded views 300 respectively of the spacer 210, a boattail aft section and a cruciform insert. The cruciform 310 includes a central ring 320 with four radial spokes 330, each extending to a corresponding bore flange 340 and a detachable ram brake 350 that attaches to the flange 340. A sheer plug 360 inserts into the ring 320. The number of spokes 330 is exemplary and not limiting.

For the advanced projectile, the bolt 360 has an outer diameter of 1.40" and a length of 1.315". The cruciform 310 has a radial span of about four inches. These dimensions are exemplary and not limiting, depending on the munition size. The attachment 220 connects to the boattail and includes an endcap 370 aligned to the boattail 170 by angularly distributed dowels 380 and secured by a threaded steel bolt 390 at 500 ft-$lb_f$ torque. The dowels 380 are circumferentially arranged around the bolt 390. The ring 320 covers the endcap 370, which includes a center cavity that receives the plug 360. The cruciform 310, plug 360 and endcap 370 are composed of 6061 aluminum alloy.

Figure 4A:
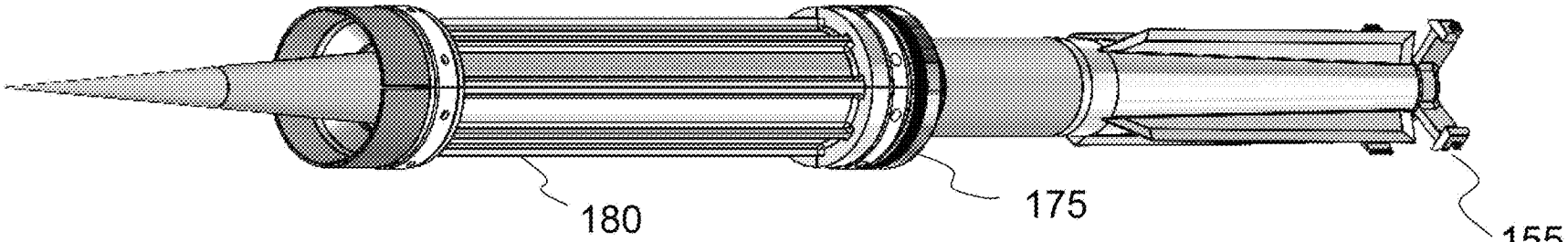
FIGS. 4A and 4B are respective perspective and elevation views of the projectile.
Figure 4B:
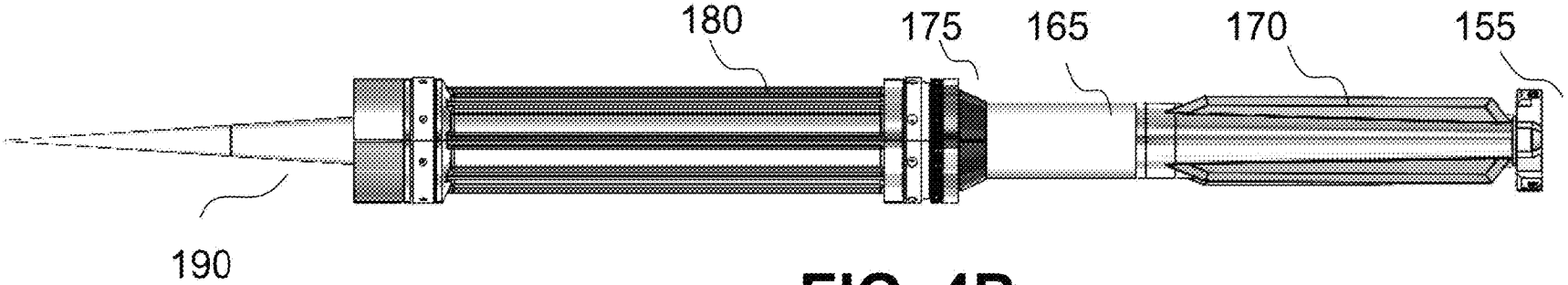
Figure 6:
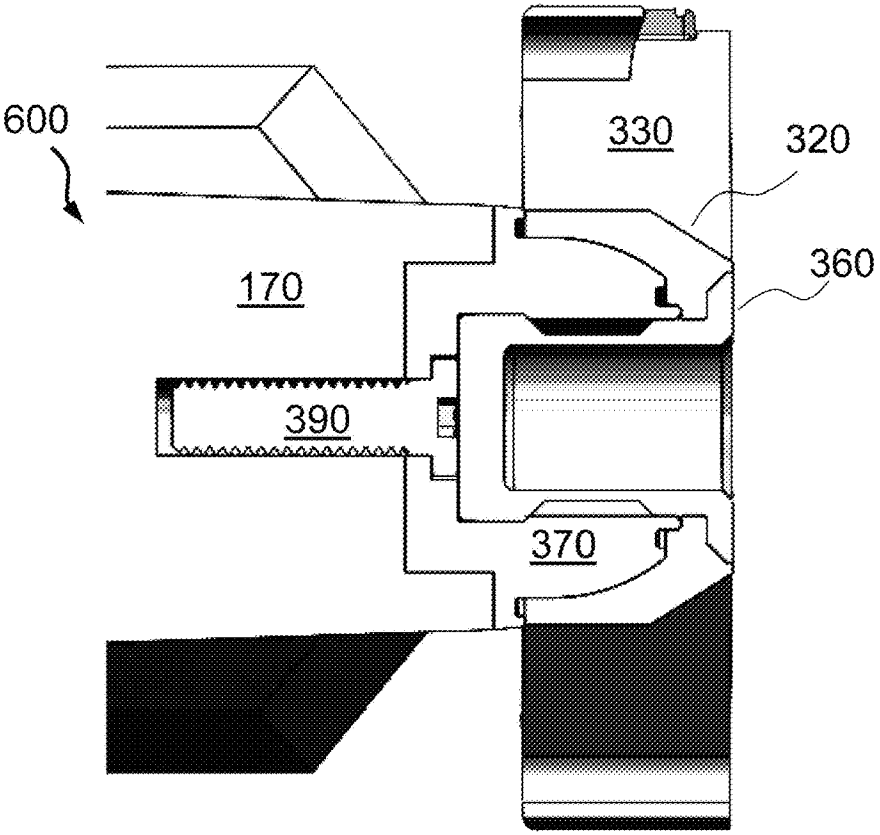
FIG. 6 is an elevation cross-section view of the boattail.
Figure 5:
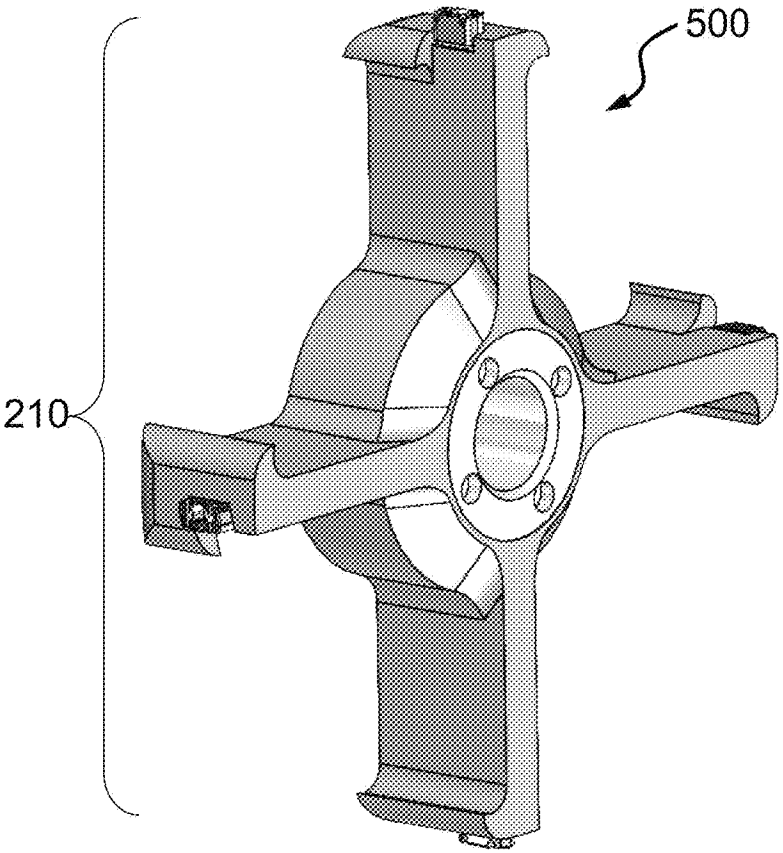
FIG. 5 is a perspective assembly view of the cruciform insert.
Figure 7:
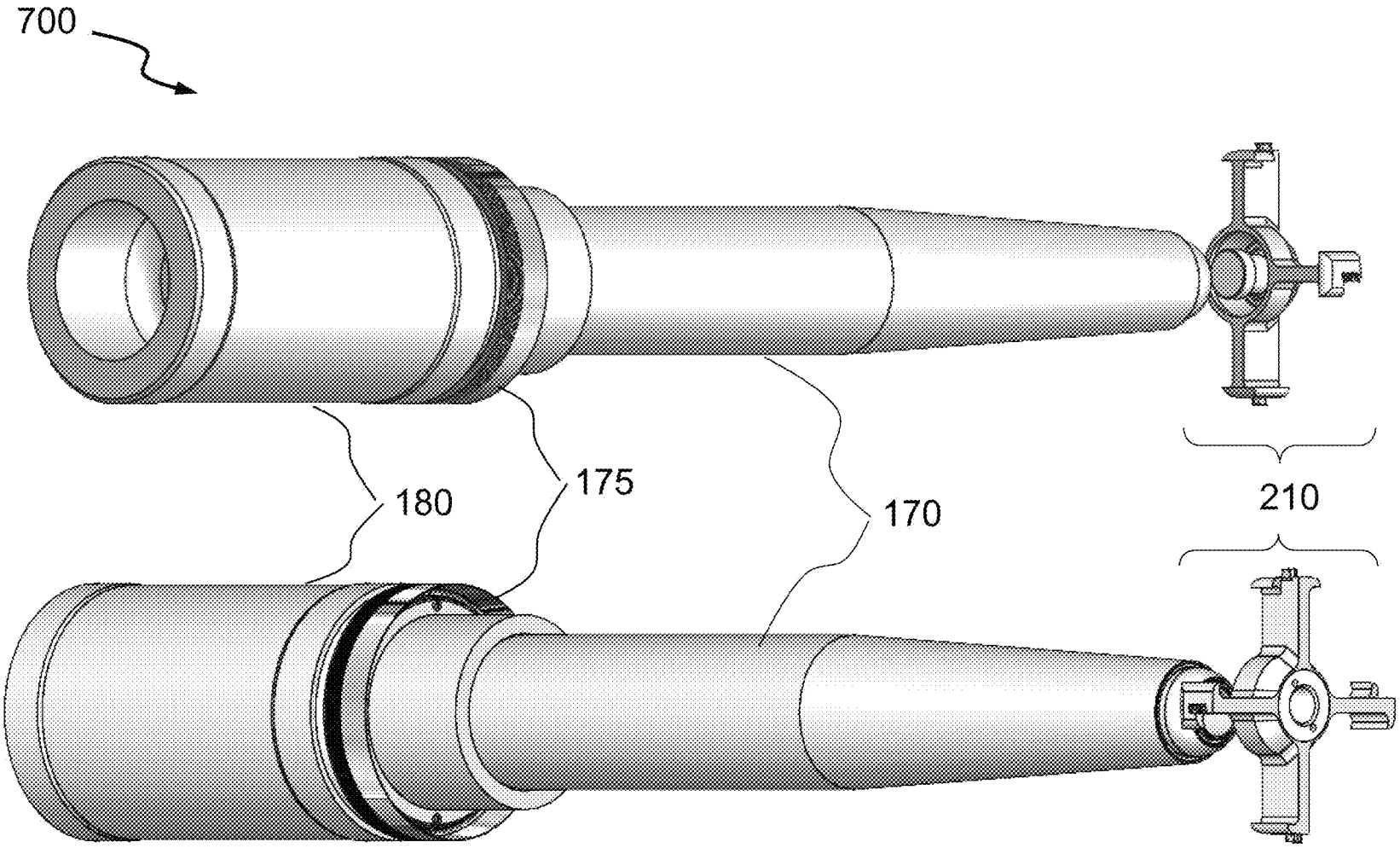
FIG. 7 is a pair of perspective views of the payload.

FIGS. 4A and 4B show respective perspective and elevation assembly views 100 of the munition 140 forward of the propellants 150 and 160. FIG. 5 shows a perspective assembly view 500 of the spacer 210 with the plug 360 inserted into the cruciform 310. FIG. 6 shows an elevation cross-section assembly view 600 of the insert 155 within the boattail 170 held by the bolt 390. FIG. 7 shows a pair of perspective assembly views 700 of the payload 180 and the insert 155 attached to the boattail 170.

Exemplary embodiments enable a payload 180 and boattail 170 to be rammed into the barrel 120 via a discarding insert 155 and a sub-caliber obturator 175. The cruciform 310 of the discarding insert 155 is then jettisoned from the payload 180 past the muzzle of the barrel 120. The embodiments facilitate increased chamber volume and additional propellant around the base of the payload 180 while satisfying all fixed gun mount interface requirements for handling, ramming, seating, and sealing of high pressure gases.

This securing gas pressure during the interior ballistic cycle is called obturation and can be accommodated by an obturator 175. The increased chamber volume resulting from this available for propellants 150 and 160 around the aft portion of the projectile's sub-caliber payload 180 enables higher muzzle energy, which increases exit velocity for improved ballistic performance.

While certain features of the embodiments of the invention have been illustrated as described herein, many modifications, substitutions, changes and equivalents will now occur to those skilled in the art. It is, therefore, to be understood that the appended claims are intended to cover all such modifications and changes as fall within the true spirit of the embodiments.

What is claimed is:

1. A device for inhibiting pitch and yaw within a barrel bore of a gun-launched projectile having a nose and a boattail, said device comprising:

an endcap that attaches to the boattail, said endcap having a center cavity;

a cruciform having a central ring that engages around said endcap, and a plurality of radial spokes, each spoke extending from said ring and ending in a flange that engages the bore; and a plug that inserts into said ring and said cavity, wherein said plug sheers away from said endcap after the projectile launches from the bore, thereby causing said cruciform to separate from said endcap.

2. The device according to claim 1, wherein said endcap attaches to the boattail by a threaded bolt.

3. The device according to claim 2, wherein said endcap, cruciform and plug are composed of aluminum alloy, and said bolt is composed of steel.

4. The device according to claim 1, wherein said endcap aligns to the boattail by an angularly distributed plurality of dowels.

5. The device according to claim 1, wherein said plurality of spokes is four.

6. The device according to claim 1, wherein each said flange further includes a detachable ram brake.

7. The device according to claim 1, wherein said cruciform radially extends approximately four inches.

* * * * *